US005627001A

United States Patent [19]

Vail

[11] Patent Number: 5,627,001

[45] Date of Patent: May 6, 1997

[54] COATED CARRIER PARTICLE CONTAINING A CHARGE CONTROL AGENT

[75] Inventor: Wilfred E. Vail, Litchfield, N.H.

[73] Assignee: Nashua Corporation, Nashua, N.H.

[21] Appl. No.: 539,401

[22] Filed: Oct. 5, 1995

[51] Int. Cl.[6] ..... G03G 9/113

[52] U.S. Cl. ..... 430/108

[58] Field of Search ..... 430/106, 108

[56] References Cited

U.S. PATENT DOCUMENTS

| | | | |
|---|---|---|---|
| 3,778,262 | 12/1973 | Queener et al. | 96/1 R |
| 3,873,355 | 3/1975 | Queener et al. | 117/201 |
| 3,873,356 | 3/1975 | Queener et al. | 117/201 |
| 4,822,708 | 4/1989 | Machida et al. | 430/106.6 |
| 5,200,287 | 4/1993 | Ohmura et al. | 430/106 |
| 5,288,577 | 2/1994 | Yamaguchi et al. | 430/106.6 |
| 5,336,579 | 8/1994 | Zimmer et al. | 430/108 |

FOREIGN PATENT DOCUMENTS

| | | |
|---|---|---|
| 0020181 | 12/1980 | European Pat. Off. . |
| 0034423 | 8/1981 | European Pat. Off. . |
| 0426124A2 | 5/1991 | European Pat. Off. . |
| 0533172A1 | 3/1993 | European Pat. Off. . |

OTHER PUBLICATIONS

Ricoh, et al. "Carrier For Electrophotographic Dry Developer" *Patent Abstracts of Japan*, vol. 8, No. 105, p. 274 [1542] (May 17, 1984).

*Primary Examiner*—John Goodrow

*Attorney, Agent, or Firm*—Testa, Hurwitz & Thibeault, LLP

[57] ABSTRACT

An improved carrier particle for use with a toner in electrostatic copying is described. The particle comprises an electroconductive core and a coating. In one embodiment the coating is made by combining a fluorocarbon resin with a charge control agent that has the same polarity as the toner. The carrier imparts a strongly positive triboelectric charge to the toner while resisting adhesion of toner particles.

21 Claims, 2 Drawing Sheets

RICOH 410 TONER - 2%
CHARGE-TO-MASS RATIO IN μ-COULOMBS/GRAM

| CARRIER ID | 2 MIN. | 20 MIN. | 2 HR. | 20 HR. |
|---|---|---|---|---|
| RICOH 410 | 11 | 13.5 | 13.2 | 8.3 |
| A:11% CARBON/3% Nig | 10.3 | 13.1 | 15.3 | 15.1 |
| B:10% CARBON/1.5% Ni | 10.1 | 11.9 | 13.5 | 12.5 |
| C:10% CARBON/6% Nig | 11.7 | 16.3 | 20.2 | 21.7 |
| D:12% CARBON/1.5% Ni | 9.5 | 11.4 | 12.4 | 10.8 |
| E:12% CARBON/6% Nig | 11.5 | 15.9 | 18.8 | 19.2 |

COATED CARRIER PARTICLE CONTAINING A CHARGE CONTROL AGENT

FIELD OF THE INVENTION

The present invention relates to carrier particles for use in electrostatic copying processes, and in particular to carrier particles having a charge control agent.

BACKGROUND OF THE INVENTION

The present invention relates to an improved carrier particle for use with a toner in an electrostatic copying process. Such processes are now commonly used by laser printers and photocopy machines.

Electrostatic processes typically use developers that have two components: toner particles and carrier particles. The carrier particles impart a triboelectric charge to the toner particles with a proper polarity and magnitude to insure that the toner particles are preferentially attracted to desired image areas on a latent image field. The magnitude of the triboelectric charge is important. If the charge is too low, the attractive force between the carrier particles and the toner particles will be too weak, resulting in "background," that is, the transfer of too much toner from the carrier. If the charge is too high, not enough toner is transferred from the carrier, resulting in low print density.

Additionally, it is important for the carrier particles to have low surface energy. Low surface energy makes it difficult for the toner particles to permanently adhere to the carrier particles. Permanent adhesion of toner particles to carrier particles impairs the normal triboelectric charging of the remaining toner particles, resulting in decreased output quality and shortened developer life.

Therefore, it is desirable for carrier particles to have a strong triboelectric charge so that toner particles can be attracted and deposited in sufficient quantities to achieve high print density while at the same time resisting the permanent adhesion of toner particles so that developer life is increased and output quality remains stable and good over the life of the developer.

The present invention provides the aforementioned desirable characteristics while avoiding the undesirable characteristics of prior art carrier particles.

SUMMARY OF THE INVENTION

An improved carrier particle for use in electrostatic copying processes is provided having a core coating of fluorocarbon resin combined with a charge control agent having the same charge polarity as the triboelectric charge imparted to the toner particles. Such a carrier particle generates a strongly negative triboelectric charge with respect to toner particles while retaining a good "non-stick" surface. The charge control agent in the coating serves to mitigate the resin's strong charge, thus preventing toner particles from building up on the surface of a carrier particle, and has the unexpected result of increasing the resulting toner charge in proportion to the amount of agent in the coating. This allows increased amounts of toner to be used for solid image development without a resulting increase in "background."

In one embodiment, the coating is a fluorocarbon resin with a charge control agent that has the same polarity as the toner. In another embodiment, the fluorocarbon resin is a copolymer of polyvinylidene fluoride and tetrafluoroethylene. The charge control agent, in one embodiment, is a metal chelate dye, referred to hereinafter as an organometallic dye.

Other embodiments of the carrier particle include electroconductive cores made of ferrite, iron or steel. In yet other embodiments, electroconductive particles, such as carbon black particles, metal particles, or metal oxide particles, are added to the coating when the electroconductive core is resistive.

DETAILED DESCRIPTION OF THE INVENTION

Figure 1:
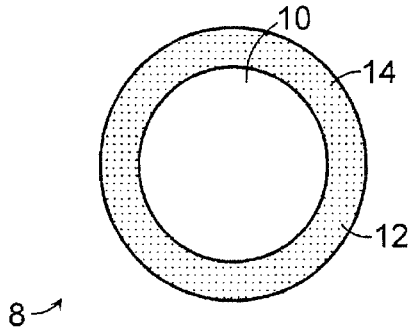
FIG. 1 is an highly schematic cross-sectional view of a carrier particle.

Referring now to FIG. 1, the improved carrier particle 8 of the present invention includes an electroconductive core 10. Electroconductive core 10 is coated with a fluorocarbon resin 12 that includes a charge control agent.

In various embodiments the core 10 is ferrite, iron, iron-providing material that has been passivated by oxidation, steel, or steel-providing material that has been passivated by oxidation. Ferrite alloys, such as nickel-zinc ferrite and copper-zinc ferrite, are acceptable. Such core material may be solid or porous. Core particles 10 may be irregularly shaped and may be as large as 450μ in diameter, although it is preferred that core particles 10 have a mean diameter of 80μ.

The resin 12, in the preferred embodiment, is selected for its strongly negative triboelectric charge, that is, when toner is rubbed against the carrier particle, the toner acquires a positive (+) charge and the carrier particle acquires a negative (−) charge. Several polymeric materials such as polystyrene, polypropylene, polyethylene, poly-vinyl chloride, polyvinylidene fluoride and tetrafluoroethylene are all known to be sufficiently electronegative to impart a strong charge to toner particles. Fluoropolymers are preferred because they are chemically non-reactive and impart "anti-stick" properties to the surface of the carrier particle 8, which prevents toner "impaction" or "filming" during use. Toner "impaction" describes the phenomena of permanent adherence of toner particles to carrier particles.

One such preferred fluoropolymer compound is a copolymer of polyvinylidene fluoride and tetrafluoroethylene. A suitable copolymer of polyvinylidene fluoride and tetrafluoroethylene, having a molecular weight of 150,000, is sold under the name KYNAR® 7201 or KYNAR® SL. KYNAR® 7201 is manufactured by ELF ATOChem, Philadelphia, Pa., as is KYNAR® SL. The ratio of polyvinylidene fluoride to tetrafluoroethylene in the copolymer may take on any value, provided the fluoropolymer compound retains a degree of solubility sufficient to allow the compound to be coated on the core.

The charge control agent, which is mixed with the resin, is selected to match the polarity of the charge induced on the toner. In the present invention, the charge control agent must have a positive charge, and an organometallic dye is added to the resin 12 to achieve this effect. In particular, the organometallic dye Nigrosine Base B has been found to be a particularly advantageous dye to incorporate into the resin 12. The chelated metal cannot be easily removed and is responsible for the ability of Nigrosine to absorb light in the infrared region. Although the exact mechanism by which it functions is not clear, it is believed that the addition of an organometallic dye moderates the attractive force that highly charged particles have towards the carrier surface. The dye content of the coating may vary from as small as 0.1% to 20% by weight.

In other embodiments, particles 14 of an electroconductive substance may be added to the resin 12 when the electroconductive core 10 is resistive. The addition of such particles 14 renders the surface of the coating electroconductive. This, in turn, reduces the tendency of the toner particles to "bunch" in any one place of the latent image field. Electroconductive particles 14 may be carbon black particles, metal particles, metal oxide particles, or particles of another electroconductive substance. It is contemplated that electroconductive particle content of the coating may be as small as 2% and as large as 16% by weight.

EXAMPLE I

Figure 2:
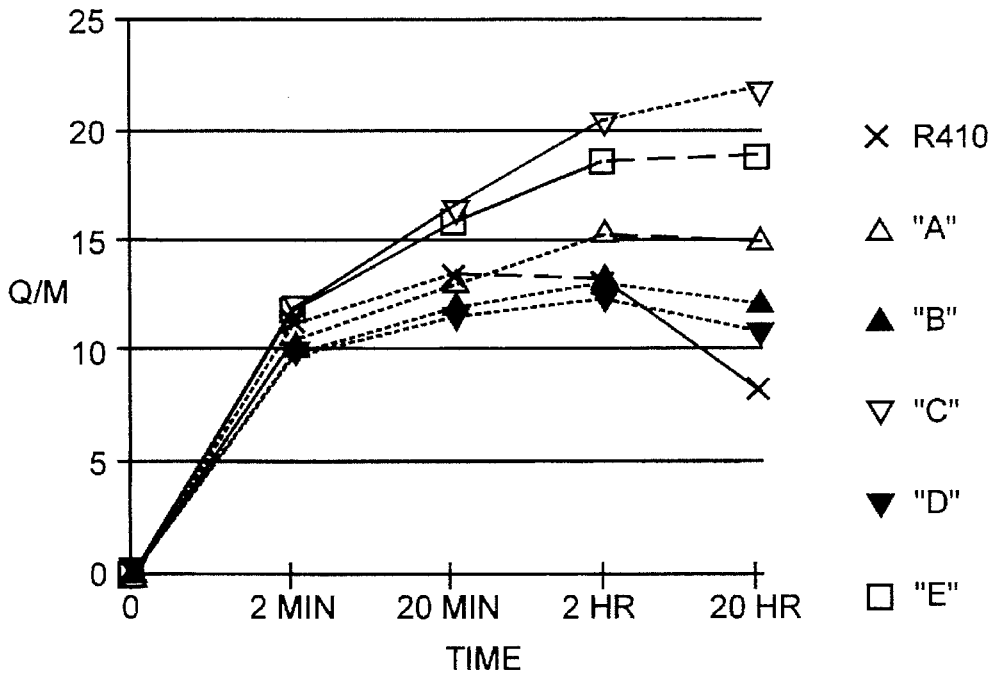
FIG. 2 is a graph of the relationship between toner charge-to-mass ratio and mixing time where the toner concentration as weight of developer is 2%.

FIG. 2 shows the result of experimentation with five sample carrier particle coatings, and emphasizes that an unexpected result of adding Nigrosine Base B to the resin 12 is that the resultant toner charge increases in proportion to increasing amounts of the dye. FIG. 2 plots resultant toner charge-to-mass ratio as a function of mixing time, where toner concentration as weight of developer is 2%. Toner charge-to-mass ratio has units of μCoulombs per gram and is the charge acquired by 1 gram of toner. The toner for all five sample carrier particle coatings is Ricoh 410 toner, as manufactured by Ricoh Company, Ltd., Tokyo, Japan.

Sample coating "A" included 3% Nigrosine Base B and 11% carbon black particles. Sample coating "B" was coated with a compound including 1.5% Nigrosine Base B and 10% carbon black particles. Sample coating "C" was 6% Nigrosine Base B and 10% carbon black particles. Sample coating "D" included 1.5% Nigrosine Base B and 12% carbon black particles. Sample coating "E" included 6% Nigrosine Base B and 12% carbon black particles. The sample carrier coatings were then mixed with toner particles for 2 minutes, 20 minutes, 2 hours, and 20 hours. After each mixing, resultant toner charge was measured.

As can be seen from FIG. 2, the highest charge for each mixing time was achieved by sample coating "C," containing 6% Nigrosine Base B dye. The lowest charge for each mixing time was achieved by sample coating "D," which contained only 1.5% Nigrosine. Additionally, as can also be seen from FIG. 2, resultant toner charge declined with increasing mixing time for all sample carrier coatings except those having 6% Nigrosine dye added to them. Coatings with 6% Nigrosine dye show a increasing toner charge for mixing times as long as 20 hours. Thus, increasing amounts of Nigrosine Base B led to an increased resultant toner charge and a longer developer life.

From FIG. 2 it can also, be seen that varying the amount of electroconductive particles 14 in the coating has only a small effect on resultant toner charge. For mixing times up to 20 hours, the sample carrier particles having coatings containing 6% Nigrosine had the highest resultant toner charge, even though electroconductive particle content differed between the two. Thus, resultant toner charge may be regulated by mixing the charge control agent with an appropriate amount of electroconductive particles.

Figure 3:
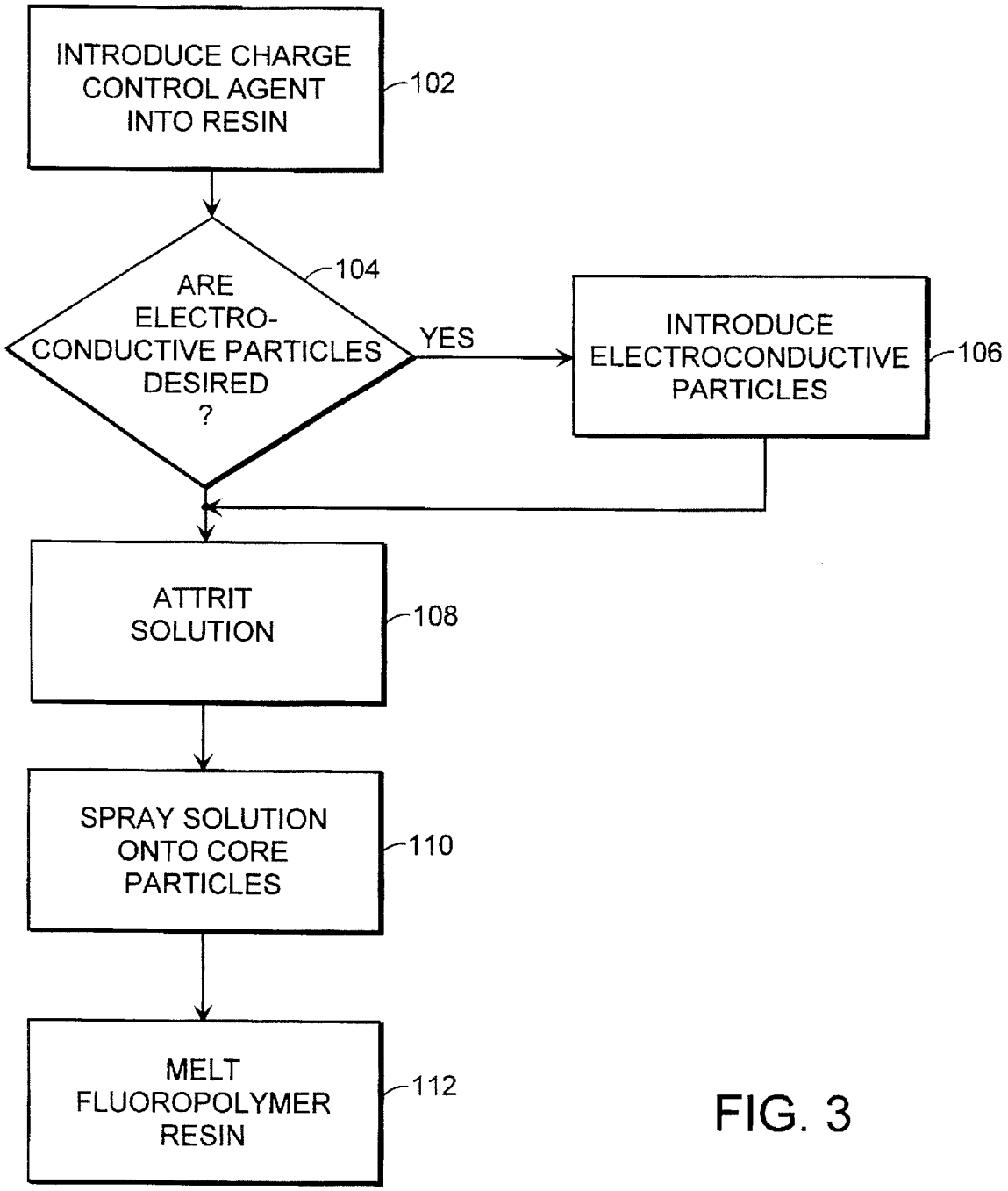
FIG. 3 is a flowchart describing the process for manufacturing the carrier particles.

Referring now to FIG. 3, a process for manufacturing the improved carrier particles 8 of the present invention is described. The first step is to introduce the charge control agent into the resin 12 (step 102). If it is desired (step 104) to add electroconductive particles 14 to the resin 12, they are added at this time (step 106). The addition of material can be accomplished in any of a number of ways. In one embodiment the resin 12 is dissolved in a solvent before the charge control agent and the electroconductive particles 14, if so desired, are added to the resin solution. The resin solution is then ground (step 108) in order to disperse the charge control agent throughout the solution as well to disperse the electroconductive particles 14, if present, to a very fine size. In one embodiment, the solution is placed into an Intermittent Type Attritor, manufactured by Union Process, Inc. of Akron, Ohio. The grinding media for this attritor, which has a volume of 1.5 pints, is ⅛" steel balls. A water jacket at ambient temperature is used to prevent solvent evaporation due to heat build-up caused by friction.

The coating solution is sprayed onto particles that serve as the electroconductive core 10. This can be done by a number of different techniques. In one embodiment, the coating is sprayed (step 110) onto the particles using a Wurster column type fluidized bed coater, such as manufactured by Lakso Corp., Leominster, Mass. The inlet air temperature is held within a range high enough to prevent agglomeration, which occurs when the solvent containing the coating is not evaporated from the core particles 10 before they contact one another, yet low enough to prevent the solvent containing the coating material from drying out before the coating attaches to the core particles 10. For example, if methyl ethyl ketone is the chosen solvent, and KYNAR® 7201 having molecular weight 150,000 is the fluoropolymer, the, air inlet temperature is held between 125° C. and 130° C. After the coated particles dry, they are heated in order to melt (step 112) the fluoropolymer resin 12 into a continuous film on the electroconductive core particles 10. Melting the resin 12 greatly increases the adhesion of the coating to the core material 10. One way of accomplishing the melting step is to feed the coated particles into a lab tube furnace at a feed rate and tube temperature sufficient to melt the resin while avoiding decomposition of the particles or the dye. For example, for particles having a coating of KYNAR® 7201, molecular weight 150,000, and a Nigrosine Base B dye, a feed rate of 7 to 10 grams/minute while keeping the tube's temperature at approximately 130° C. is sufficient to melt the resin. However, the temperature must not be allowed to exceed 180° C., in which case the Nigrosine Base B will decompose. A suitable lab tube furnace is manufactured by Thermcraft, Inc., Winston-Salem, N.C..

Although only preferred embodiments are specifically illustrated and described herein, it will be appreciated that many other modifications and variations of the present invention are possible in light of the above teachings and within the preview of the appended claims without departing from the spirit and intended scope of the invention. Other objects, features and advantages of the invention shall become apparent when the following drawings, description and claims are considered.

What is claimed is:

1. A carrier particle for use with a toner in electrostatic copying comprising:

an electroconductive core; and a coating on said electroconductive core, said coating comprising a fluorocarbon resin and a charge control agent wherein said charge control agent has about the same polarity as said toner.

2. The carrier particle of claim 1 wherein said fluorocarbon resin is a copolymer of polyvinylidene fluoride and tetrafluoroethylene.

3. The carrier particle of claim 1 wherein said charge control agent is a dye.

4. The carrier particle of claim 3 wherein said dye is an organometallic dye.

5. The carrier particle of claim 4 wherein said organometallic dye is Nigrosine Base B.

6. The carrier particle of claim 1 wherein said electroconductive core is ferrite.

7. The carrier particle of claim 1 wherein said electroconductive core is iron.

8. The carrier particle of claim 1 wherein said electroconductive core is steel.

9. The carrier particle of claim 1 wherein said toner acquires an amount of positive charge which is proportional to the amount of charge control agent in said carrier coating.

10. The carrier particle of claim 1 wherein said electroconductive core is resistive, and wherein electroconductive particles are added to said coating.

11. The carrier particle of claim 10 wherein said electroconductive particles are carbon black particles.

12. The carrier particle of claim 10 where said electroconductive particles are metal particles.

13. The carrier particle of claim 10 where said electroconductive particles are metal oxide particles.

14. A carrier particle for use with a toner in electrostatic copying comprising:

an electroconductive core; and a coating on said electroconductive core, said coating comprising a fluorocarbon resin, a plurality of electroconductive particles, and a charge control agent, wherein said charge control agent has about the same polarity as said toner.

15. The carrier particle of claim 14 wherein said charge control agent is a dye.

16. The carrier particle of claim 14 wherein said electroconductive particles are carbon black particles.

17. A carrier particle for use with a toner in electrostatic copying comprising:

an electroconductive core; and a coating on said electroconductive core, said coating comprising a polymeric resin and a charge control agent, wherein said charge control agent has about the same polarity as said toner.

18. A method for manufacturing an improved carrier particle for use in an electrostatic copying process, the method comprising the steps of:

(a) providing an electroconductive core particle; and (b) coating the core particle with a resin, wherein the resin contains a charge control agent.

19. The method of claim 18 wherein step (b) comprises coating the core particles with a resin, wherein the resin contains electroconductive particles and a charge control agent.

20. The method of claim 18 wherein said coating step is achieved by spraying the resin onto the core particles.

21. The method of claim 18 further comprising the step of melting the resin coating after step (b).

* * * * *